United States Patent [19]

Švercl et al.

[11] 4,434,645

[45] Mar. 6, 1984

[54] APPARATUS FOR THE RADIAL SHAPING OF TUBULAR ARTICLES

[75] Inventors: Josef Švercl, Olomouc; Jan Novak, Třebčín; Zdeněk Kaláb, Urcice, all of Czechoslovakia

[73] Assignee: SIGMANKoncern, Olomouc, Czechoslovakia

[21] Appl. No.: 288,167

[22] Filed: Jul. 29, 1981

[30] Foreign Application Priority Data

Aug. 1, 1980 [CS] Czechoslovakia ..... 5372-80
Dec. 2, 1980 [CS] Czechoslovakia ..... 8350-80

[51] Int. Cl.[3] ..... B21D 41/00

[52] U.S. Cl. ..... 72/402; 72/404; 72/446

[58] Field of Search ..... 72/402, 404, 76, 121, 72/408, 446, 451

[56] References Cited

U.S. PATENT DOCUMENTS

| | | | |
|---|---|---|---|
| 684,216 | 10/1901 | Gardner et al. | 72/402 |
| 758,195 | 4/1904 | Schneinert et al. | 72/402 |
| 3,033,055 | 5/1962 | Hähnel | 72/446 |

*Primary Examiner*—Francis S. Husar
*Assistant Examiner*—David B. Jones
*Attorney, Agent, or Firm*—Murray Schaffer

[57] ABSTRACT

Apparatus for radial shaping of rotors, stators, crankshafts, spindles and the like from an elongate seamless tube where a supporting ring performing a reciprocating motion according to an adjustable stroke of a connecting rod causes by way of rollers and guiding segments a reduction and increase of the radial distance of sliding shoes with forming jaws with respect to the formed object.

14 Claims, 7 Drawing Figures

APPARATUS FOR THE RADIAL SHAPING OF TUBULAR ARTICLES

BACKGROUND OF THE INVENTION

The invention relates to apparatus for the radial shaping of objects such as shaped spindles for rotors and stators of single spindle pumps, and the like.

Arrangements are known for manufacture of rotors for single spindle pumps from an elongate seamless tube by cold shaping methods in which a forming tool having at least three forming jaws is controlled either by a press as it is the case disclosed in the Czechoslovak Certificate of Authorship of an Invention No. 135,995, corresponds to U.S. Pat. Nos. 3,606,789 and 3,740,811, or by a direct drive of individual sliding shoes provided with forming jaws by way of eccentrics. The first mentioned arrangement requires the application of a special press, which by means of a wedge situated on the press ram acts via rods and a pressure plate on faces of forming jaws which are thus inserted into a conical space of a casing.

A drawback of this arrangement is the high power requirements for the press in order to overcome resistances between the wedge, rod, pressure plate and jaws. Further disadvantages lie in the substantial wear of working parts of the arrangement, their frequent seizure and damage by cracks.

The second arrangement requires no special press as it has its own drive and transmission to the individual sliding shoes which are provided with the forming jaws. Its drawback is, however, that its working stroke is constant and cannot be changed in the course of operation. The drive of this latter arrangement requires, therefore, the construction of a transmission gear and of transmissions which increase the size and weight of the proper arrangement.

It is an object of the present invention is to provide an arrangement for radial shaping, particularly for shaping of objects having the form of a spindle, which would not require special transmissions for driving and which would enable the change of the working stroke in the course of operation corresponding to different requirements during shaping. These and other objects will be obvious from the following disclosure.

SUMMARY OF THE INVENTION

The arrangement according to the present invention is provided with at least two forming jaws situated exchangeably on sliding shoes supported pivotably on rods. The frame of the arrangement comprises at least two guiding segments situated between a left side wall and a right side wall. Along the external rolling surface of the guiding segments a supporting ring is arranged which is freely rotatable and on which ring rollers are supported on eccentric pins.

Rods with sliding shoes which bear forming jaws are also supported on supporting pins on the supporting ring. The ring is provided on its external circumference with eyelets for pivotable support of a connecting rod, the other end of which rod is supported by an eccentric sleeve, supported in turn on an eccentric pin of a driving shaft.

Guide surfaces for the sliding shoes are provided between the guiding segments. The guide widens towards the other circumference of the guiding segments in order to enable a swinging of the rods.

A dish shaped carrier provided on its internal face with an indentment is keyed on the eccentric pin of the driving shaft and an eccentric sleeve is provided on its side facing the dish-shaped carrier with the same indentment, to enable adjustment of the stroke of the driving shaft.

The supporting ring may be provided at its internal side with an annular recess for housing rollers and rods. It may also consist of two lateral annular elements. The frame can be composed of an annular outer shell fixed between side walls of the frame.

The supporting pins are either eccentric pins or concentric ones, in which latter case the ends of the pins are provided with sliding surfaces engaging in radial grooves of the supporting ring. Struts may be supported on supporting bolts of rods together with said rods, the struts suspended with their other ends by way of further eccentric pins on the frame.

Full details of the present invention are set forth in the following disclosure and are illustrated in the accompanying drawings.

The high advantageous effect of the present invention can be seen as a result of the simple design of the drive which is reliable in operation. The present invention enables creation of a reliable contact between the guiding rollers and the external circumference of guiding segments, without play or clearance, as well as obtaining a prestressing of the contact of the rollers with the guiding segments. The invention furthermore enables adjustment of the extreme stroke position of forming jaws by means of the eccentric pins of both the rods and of the struts and also the adjustment of the magnitude of the stroke by an adjustable eccentricity of the support for the connecting rod on the driving shaft. The present invention requires no construction of a transmission gear nor complicated transmissions.

DESCRIPTION OF PREFERRED EMBODIMENTS

Figure 1:
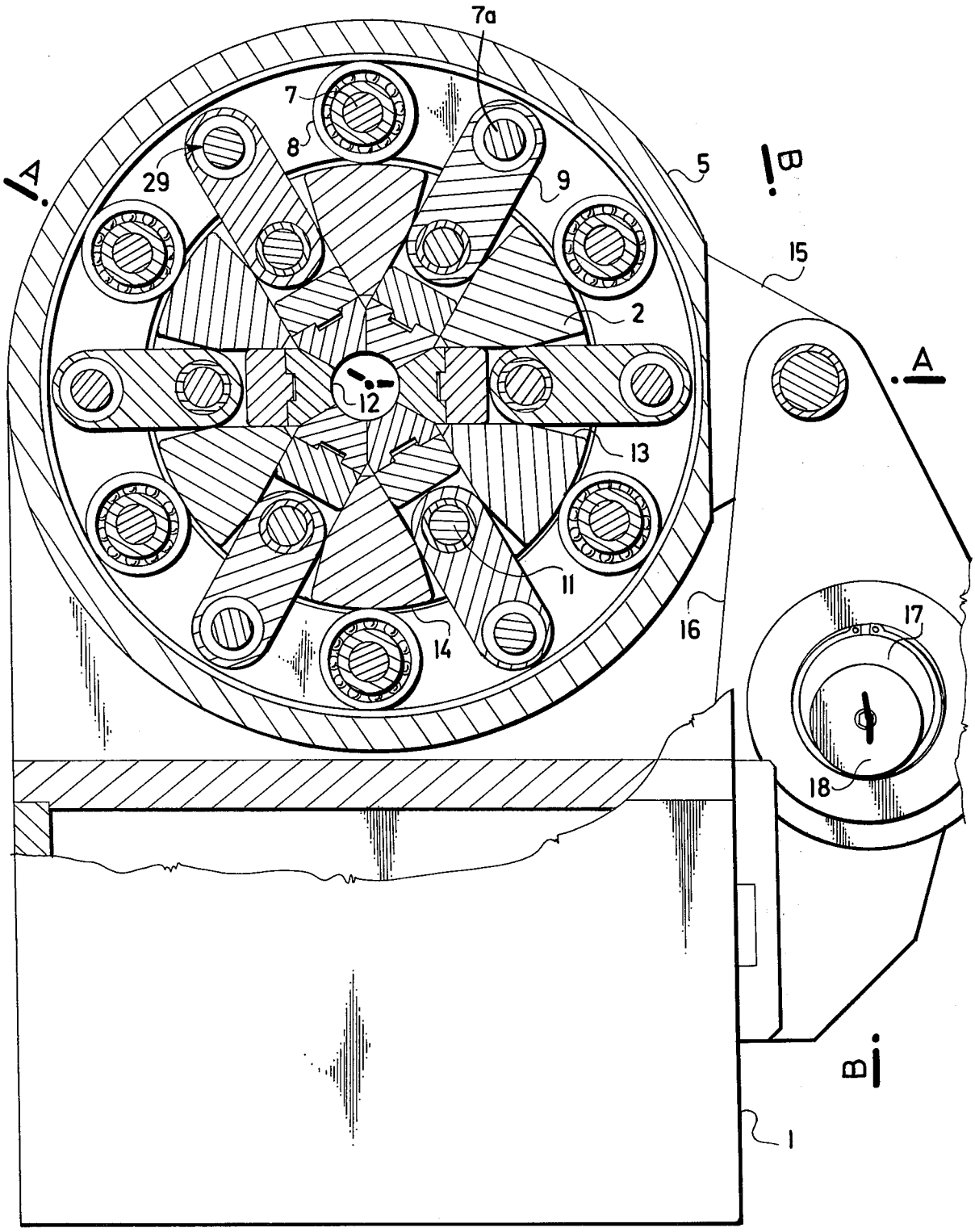
FIG. 1 is a radial sectional view of an arrangement embodying the present invention.
Figure 2:
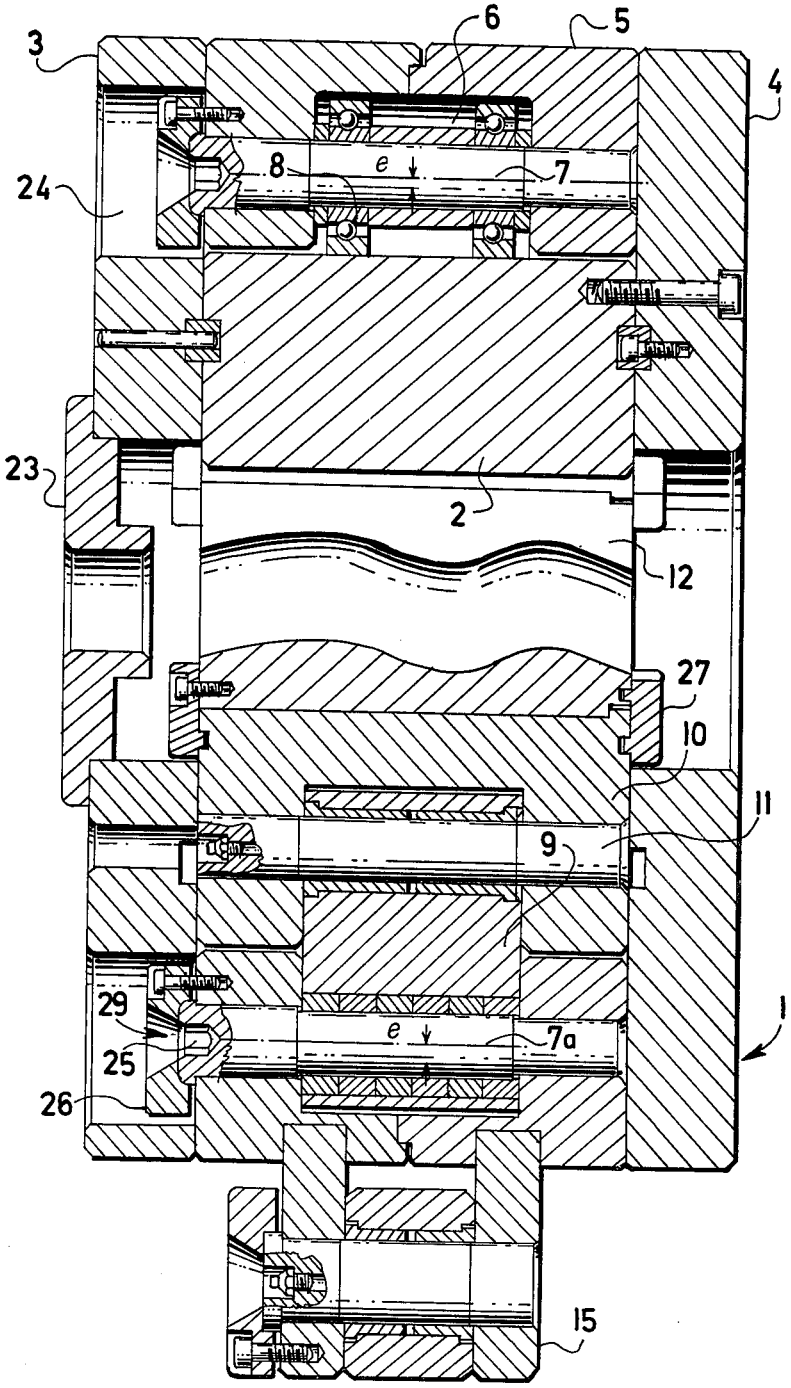
FIG. 2 is an axial sectional view of the arrangement of in FIG. 1, the section being taken along a plane indicated in FIG. 1 by A—A.

As seen from FIGS. 1 and 2, the apparatus comprises a frame generally depicted by the numeral 1 consisting of a plurality of spaced guiding segments 2 situated between a left side wall 3 and a right side wall 4. A ring 5 is supported, freely rotatable, on the external circumference of guiding segments 2 between both side walls 3 and 4. The supporting ring 5 is provided at its internal face with an annular recess 6 in which a plurality of uniformly spaced eccentric pins 7 are journalled with their axes parallel to the center of the ring 5. Between the pins 7 there are journaled a second set of eccentric pins 7a. On each of the pins 7, there is mounted a roller 8. Between the rollers 8, the remaining pins 7a pivotally mount, at their outer end, rods 9 which extend radially between pairs of the spaced segments 2. Sliding shoes 10 are pivotally mounted by means of shafts 11 to the inner ends of the rods 9. Removably supported on the ends of the shoes 10 are radially slidable forming jaws 12. The side walls 13 of the segments 2 provide a guide surface for the interposed rods 9 with shoes 10 while the outer circumferential surface 14 provides without play a guide surface for the rollers 8.

The guide surfaces 13 are widened radially outwardly on the side where the rods 9 are supported, forming also a space for the pivotable movement of the rods 9.

Figure 4:
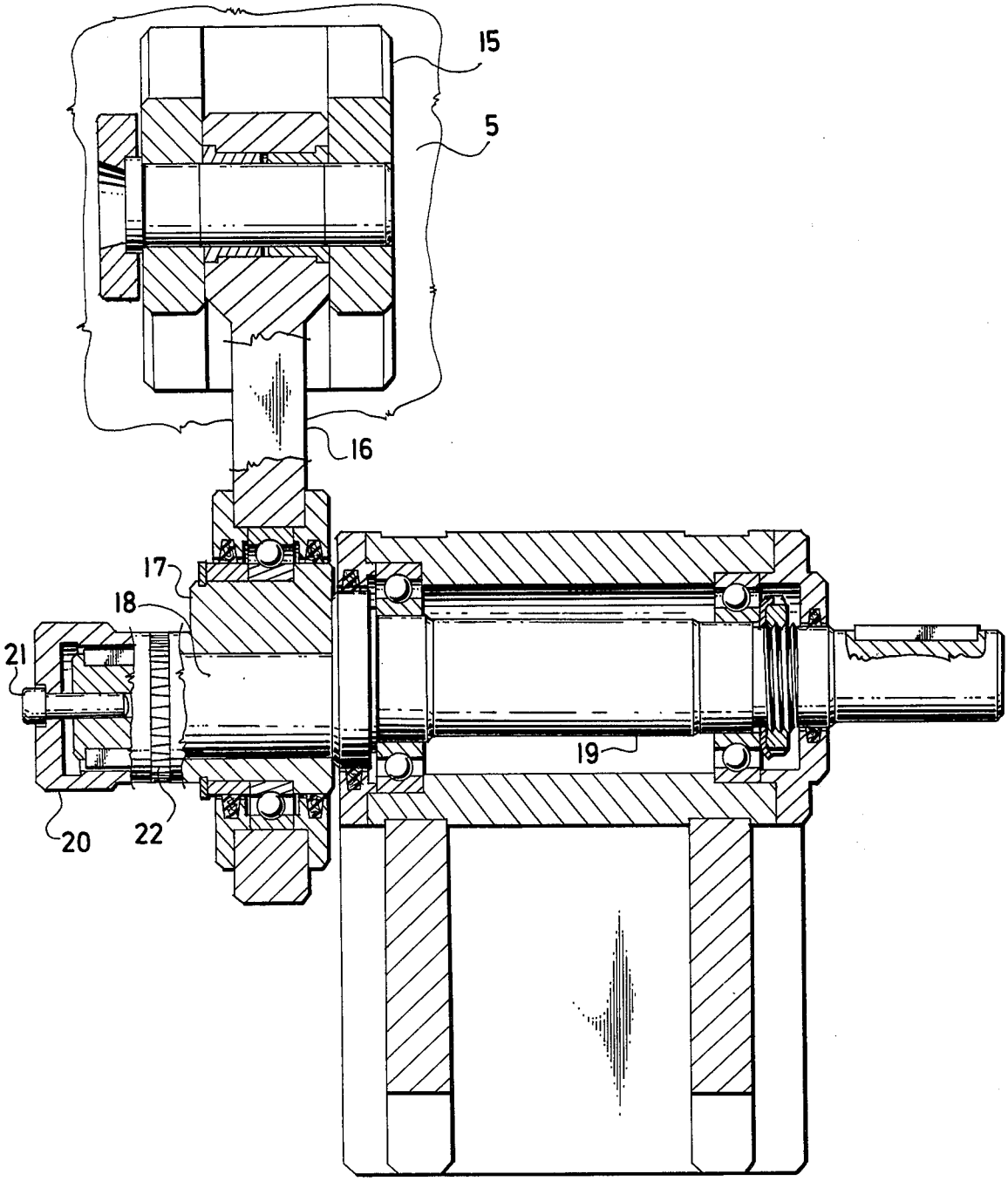
FIG. 4 is an axial sectional view of the drive assembly, the section being taken along planes indicated in FIG. 1 by B—B.

The supporting ring 5 is provided on its external circumference with a fixed bracket in which an eyelet 15 is formed. Pivotally connected to the eyelet 15 is one end of a connecting rod 16, the other end of which is supported by an eccentric sleeve 17 which, as seen in FIG. 4, is supported on an eccentric pin 18 of a driving shaft 19. A dish-shaped carrier 20 is keyed on on the external side of the eccentric pin 18 of the driving shaft 19. The position of the carrier 20 against the eccentric sleeve 17 is secured by a safety screw 21. The front surface of the eccentric sleeve 17 and the front surface of the carrier 20 adjacent thereto are provided with V-shaped indentments 22 which, by mutual engagement, represent, in fact, a claw clutch.

Figure 3:
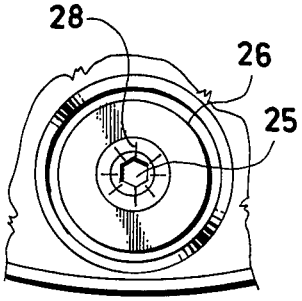
FIG. 3 shows in detail the mechanism for adjustment of the eccentricly mounted pins.

Returning to FIG. 2, the left side wall 3 of the frame 1 is provided with a sleeve 23 for guiding the introduction of the workpiece, and with a number of openings 24 for access to the eccentric pins 7 and 7a on which rollers 8 and rods 9, respectively, are mounted. The outer surface of the pins 7 are eccentric relative to their central axis and are provided at the left side wall 3 with an assembly generally depicted by the numeral 29 enabling the adjustment of the eccentricity of the pins. The end of the pins 7 and 7a are provided with a wrench socket or opening 25 and are seated in a locking ring 26, which is fixedly secured by screws to the ring 5. Rotation of the pin relative to the locking ring 26 causes adjustment of the eccentricity of the pin 7 relative to the center of the apparatus as a whole permitting adjustment of the clearance between the circumferential surface 14 of segments 2 and between the supporting ring 5, while rotation of the pin 7a causes the adjustment of the extreme position of jaws 12 relative to the center of the apparatus as a whole. As seen in FIG. 3, the face of the eccentric pin 7 is provided, around the adjustment opening 25, with a scale 28 in order to make easier the checking and adjustment of the extreme position of forming jaws 12 and of guiding rollers 8 respectively. The magnitude of the stroke of the forming jaws 12 is adjusted by the relative position of the eccentric sleeve 17 and of the eccentric pin 18 of the driving shaft 19 after prior release of the carrier 20 and disengagement of the indentment 22. The new eccentricity is secured by tightening the carrier 20 by the screw 21.

To prepare for operation, forming jaws 12 are chosen according to the diameter and shape of the desired shape of the finished workpiece and are secured in their position on shoes 10 by locks 27 and the extreme position of forming jaws 12. The extent of the stroke of the sliding shoe 10 is adjusted by means of eccentric pins 7a and rods 9 and this position is secured by the safety or locking ring 26. The required stroke of the connecting rod 16 is also adjusted by adjustment of the relative position of the eccentric sleeve 17 and of the eccentric pin 18 of the driving shaft 19, which is secured by mutual engagement of the indentments 22 of the dish-shaped carrier 20 and of the eccentric sleeve 17. The prestress of contact, without clearance, of rollers 8 with the guiding segments 2 are checked and possible shortcomings eliminated by means of adjustment of the eccentric pins 7 and rollers 8. The arrangement is then ready for operation.

Figure 5:
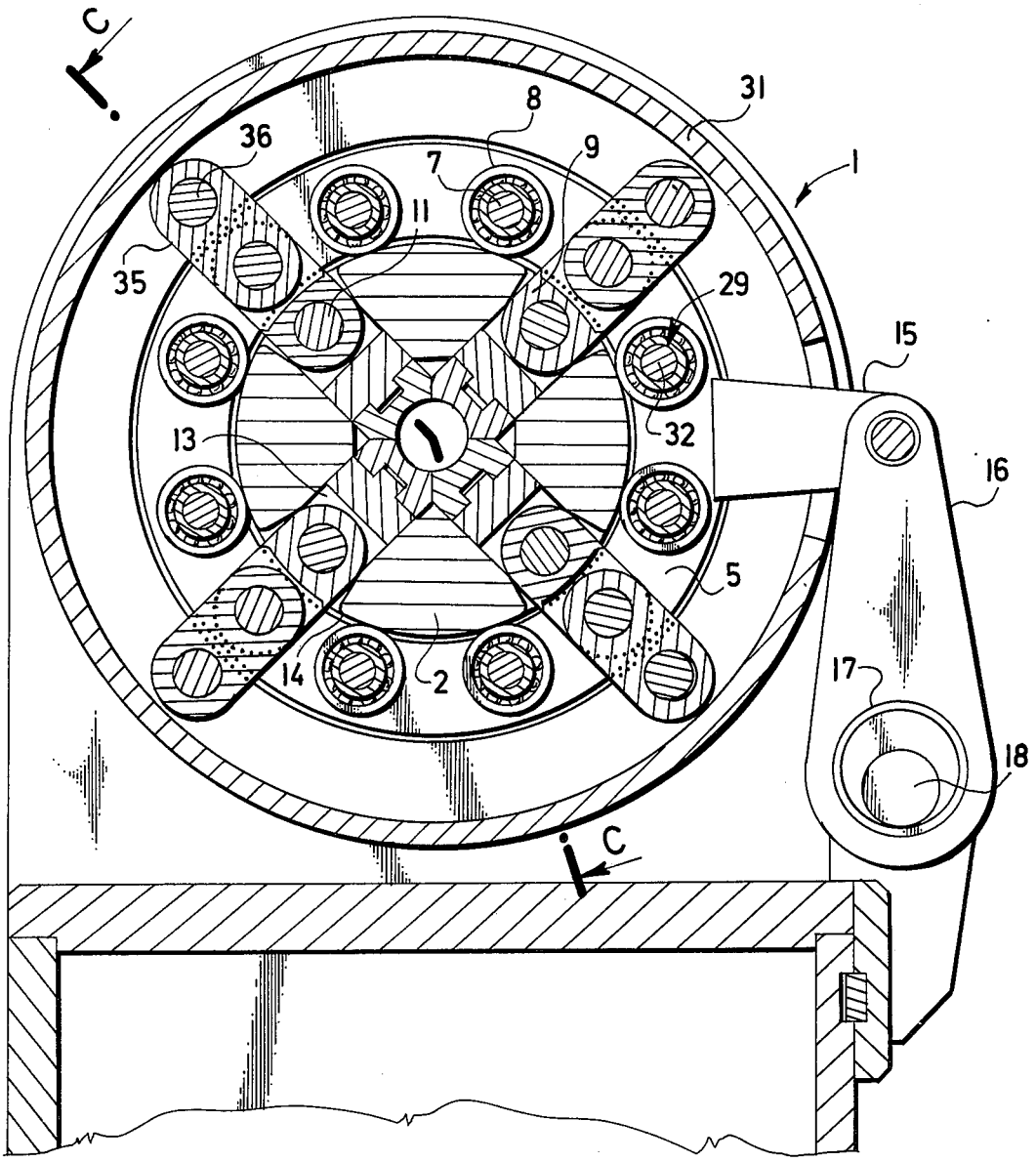
FIG. 5 is a radial sectional view of another arrangement embodying the present invention.
Figure 6:
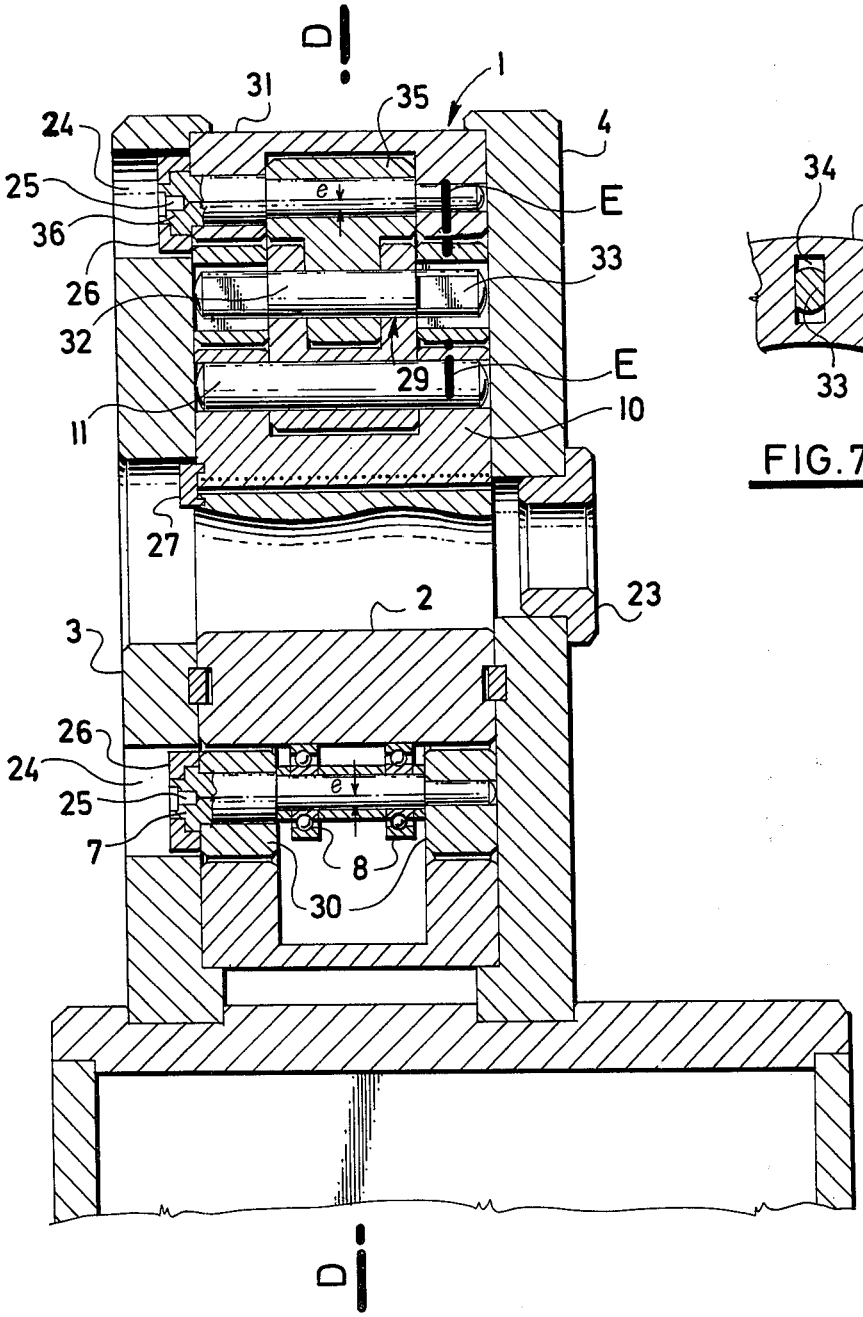
FIG. 6 is an axial sectional view of the arrangement of in FIG. 5, the section being taken along a plane indicated in FIG. 5 by C—C.
Figure 7:
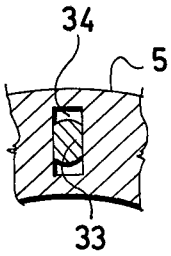
FIG. 7 is a detail of the arrangement of a supporting bolt of a rod in the supporting ring of the arrangement as in FIG. 5 in section being taken along a plane indicated in FIG. 6 by E—E.

In the alternative arrangement shown in FIGS. 5 to 7 wherein like reference numerals depict like elements according to FIGS. 1–4, the frame 1 is of a cage type comprising at least two guiding segments 2 and an outer annular shell 31 situated between both side walls 3, 4 with which they are firmly connected and provide thus an annular space for the freely rotatable supporting ring 5.

The supporting ring 5 comprises two annular side walls 30 between which rollers 8 are arranged on eccentric pins 7 and rods 9 of sliding shoes 10 are arranged on supporting pin assemblies 29. In this case, the pin assemblies 29 comprise concentric pins 32, the ends 33 of which are provided with sliding faces engaging in radial grooves 24 formed in the side walls 30 enabling the concentric bolts 32 to shift in the radial direction.

Struts 35 are provided along the radial axis passing through the center of the arrangement and through centers of connecting pins 11. The struts 35 are supported on the outer annular shell 31 on eccentric pins 36 and are suspended at their inner end on the common concentric pin 32 together with the associated rods 9 on the supporting ring 5. The eccentric pins 36 of struts 35 are again provided with a mechanism for adjustment of the extreme position of forming jaws 12, similar to that shown in FIGS. 1–4.

Adjustment for start up of operation is similarly accomplished as described with regard to FIGS. 1–4.

After starting the not shown drive motor connected to drive shaft 19, the material to be treated, for instance, an elongate seamless tube is introduced by means of the guiding sleeve 23 situated on the frame 1 in the longitudinal direction between the forming jaws 12. The rotary motion of the driving shaft 19 is transmitted via the eccentric pin 18 and of the eccentric sleeve 17 to the connecting rod 16 which performs a reciprocating motion and turns by way of eyelets 15 the supporting ring 5 alternately to the left and right. The reciprocating motion of the supporting ring 5 causes by way of rods 9 (or by way of struts 35), a reciprocating motion of sliding shoes 10 and of forming jaws 12 connected thereto within the range of the adjusted stroke. Due to the reciprocating motion of forming jaws 12, the material is radially shaped as it is simultaneous axially advanced.

This arrangement can be advantageously utilized in manufacturing, from tubular stock workpiece, finished bodies having the shape of a spindle as for instance rotors and stators of single spindle pumps in both cold shaping and hot shaping systems. In the hot shaping system, the arrangement operates as a multiram forging press enabling the shaping radially according to application of forming jaws having different profiles such as multiedged profiles, different indentments and the like.

Various modifications, changes, as well as embodiments have been shown and described. Other such variations will be obvious to those skilled in the art. Accordingly, the present disclosure is not intended to limit the scope of the present invention.

What is claimed is:

1. Appparatus for the radial shaping of rotors, spindles, shafts and the like comprising a frame having at least two guiding segments situated between a left side wall and a right side wall, said guiding segments being provided with an outer rolling surface, a freely rotatable supporting ring encompassing said guiding segments, at least two rollers rotatably supported on eccentric pins fixed on the supporting ring to engage respective ones of said segments, rods interposed between said rollers, sliding shoes bearing forming jaws connected to the inner end of said rods, the outer end of said rods being pivotally connected on supporting pins fixed to the supporting ring so that the sliding shoes with the associated forming jaws are adapted to perform a radial movement between said guiding segments on movement of said supporting ring, the supporting ring being provided on its external circumference with at least one eyelet for a connection with a connecting rod, the other end of which is supported by an eccentric sleeve, which in turn is supported by an eccentric pin connected to a driving shaft.

2. The apparatus according to claim 1 wherein the space between guiding segments is widened radially outward toward the outer circumference of guiding segments to permit a pivoting of the rods therebetween.

3. Apparatus for the radial shaping of rotors, spindles, shafts and the like comprising a frame having at least two guiding segments situated between a left side wall and a right side wall, said guiding segments being provided with an outer rolling surface, a freely rotatable supporting ring encompassing said guiding segments, at least two rollers rotatably supported on eccentric pins fixed on the supporting ring to engage respective ones of said segments, rods interposed between said rollers, sliding shoes, bearing forming jaws, connected to the inner end of said rods, the outer end of said rods being pivotally connected on supporting pins fixed to the supporting ring so that the sliding shoes with the associated forming jaws are adapted to perform a radial movement between said guiding segments on movement of said supporting ring, the supporting ring being provided on its external circumference with at least one eyelet for a connection with a connecting rod, the other end of which is supported by an eccentric sleeve, which in turn is supported by an eccentric pin connected to a driving shaft; said driving shaft having an eccentric pin and an eccentric sleeve and including a dish-shaped carrier keyed on said eccentric pin of the driving shaft, said carrier provided on its internal face with an indentment, the eccentric sleeve on the eccentric pin of the driving shaft provided on its side adjacent to the dish-shaped carrier with a corresponding indentment.

4. The apparatus according to claim 3 including a locking screw provided on the eccentric pin of the driving shaft securing the position of the dish-shaped carrier.

5. The apparatus according to claim 1 wherein the supporting ring is provided on its internal side with an annular recess for housing said rollers and rods.

6. The apparatus according to claim 1 wherein the supporting ring comprises two annular side walls.

7. The apparatus according to claim 1, wherein the frame comprises an annular outer shell fixed between side walls.

8. The apparatus according to claim 1 wherein the supporting pins of rods being eccentric pins.

9. The apparatus according to claim 1 wherein the supporting pins of rods being concentric pins, the ends of which are provided with lateral sliding surfaces, radial grooves provided in the supporting ring adapted for guiding radially the ends of said concentric supporting pins, struts suspended on said pins together with said rods, the other ends of the struts supported by eccentric pins on the frame.

10. The apparatus according to claim 3 wherein the supporting ring is provided on its internal side with an annular recess for housing said rollers and rods.

11. The apparatus according to claim 3 wherein the supporting ring comprises two annular side walls.

12. The apparatus according to claim 3, wherein the frame comprises an annular outer shell fixed between side walls.

13. The apparatus according to claim 3 wherein the supporting pins of rods being eccentric pins.

14. The apparatus according to claim 3 wherein the supporting pins of rods being concentric bolts, the ends of which are provided with lateral sliding surfaces, radial grooves provided in the supporting ring adapted for guiding radially the ends of said concentric supporting pins, struts suspended on said pin together with said rods, the other ends of the struts supported by eccentric pins on the frame.

* * * * *